United States Patent [19]

Smolinski

[11] 4,133,618

[45] Jan. 9, 1979

[54] ROTARY CAM-ACTUATED VANE MACHINE

[76] Inventor: Ronald E. Smolinski, 4081 Forest Ridge Blvd., Dayton, Ohio 45424

[21] Appl. No.: 779,918

[22] Filed: Mar. 21, 1977

[51] Int. Cl.[2] ..... F01C 1/00; F01C 21/08

[52] U.S. Cl. ..... 418/258; 418/263

[58] Field of Search ..... 418/148, 253, 256–258, 418/261, 263–265, 259, 266

[56] References Cited

U.S. PATENT DOCUMENTS

| | | | |
|---|---|---|---|
| 118,993 | 9/1871 | Wentworth | 418/265 |
| 870,290 | 11/1907 | Henkel | 418/265 |
| 1,550,286 | 8/1925 | Sorge | 418/258 |
| 1,743,539 | 1/1930 | Gasal | 418/265 |
| 2,003,615 | 6/1935 | Smith et al. | 418/265 |
| 2,590,132 | 3/1952 | Scognamillo | 418/265 |
| 2,672,282 | 3/1954 | Novas | 418/265 |
| 3,988,083 | 10/1976 | Shimizu et al. | 418/264 |

*Primary Examiner*—John J. Vrablik

*Attorney, Agent, or Firm*—Biebel, French & Nauman

[57] ABSTRACT

A rotary machine of the type which includes a rotor rotatably mounted in a stator and carrying vanes mounted for radial movement to cooperate with the inner surface of the stator to, for example, compress a gas drawn into the stator housing through an inlet port. The necessary radial movement of the vanes during rotation of the rotor is accomplished by means of cam followers associated with the vanes which ride on stationary cam surfaces. The cam surfaces are round and have their axes positioned eccentrically with respect to the axis of rotation of the rotor. Tension springs draw the vanes radially inwardly of the rotor so that the cam followers are held in contact with the cam surfaces. This provides positive vane control and prevents vane lifting while minimizing contact between the vane tips and the stator inner surface.

5 Claims, 9 Drawing Figures

ROTARY CAM-ACTUATED VANE MACHINE

BACKGROUND OF THE INVENTION

Rotary machines are used for a number of purposes, such as rotary internal combustion engines and pumps of various kinds, including compressors. In many of these a stator is provided in which is rotatably mounted a rotor carrying radially movable vanes which cooperate with the inner surface of the stator to form discrete chambers which vary volumetrically as the rotor carrying the vanes rotates within the stator.

For example, U.S. Pat. No. 3,955,540 discloses a rotary, internal combustion engine in which a rotor carrying vanes is rotatably mounted in a housing. The vanes are spring loaded to maintain their outer tips in sliding engagement with the inner surface of the housing and rollers on their inner ends in engagement with a vane race. With this construction the vanes are pressed into engagement with the inside wall of the stator housing and necessarily there are substantial frictional energy losses as well as appreciable wear of not only the vane tips but the wall against which they are pushed into sliding engagement.

U.S. Pat. No. 3,988,083 is directed to a vane type pump in which frictional engagement between the vane tips and the inside wall of the pump casing is eliminated by providing annular, outside races which are engaged by followers associated with the vanes to thereby limit outward movement of the vanes into contact with the inner wall of the casing. Centrifugal forces are relied upon in this construction to position the vane tips closely to the inner wall of the casing and prevent excessive leakage around the vane tips. However, when high internal pressures are encountered they may be sufficient to overcome the centrifugal forces acting on the vanes, and allow the vanes to lift away from the inner surface of the casing and result in substantial leakage around the vanes.

SUMMARY OF THE INVENTION

The present invention provides a vane type rotary machine in which the positions of the vane tips with respect to the stator inner surface are controlled positively by cam means engaged by cam followers associated with the vanes, and means which both urge the cam followers into positive engagement with the cam surface means and the vane tips out of sliding engagement with the stator inner surface.

In a preferred embodiment of the invention the inner surface of the stator, the rotor and the outer surface of the cam are round in cross section and the axes of the cam and the stator inner surface are concentric with respect to each other but eccentric with respect to the axis of rotation of the rotor. Tension springs urge the vanes radially inwardly with respect to the axis of rotation of the rotor, maintaining cam followers associated with the inner ends of the vanes in positive engagement with the cam surface means, but urging the vane tips out of engagement with the stator inner surface.

The vanes can be mounted in slots formed in the rotor with the vanes arranged in opposing pairs and interconnected by the tension springs holding the cam followers associated with the vanes'inner ends in contact with the cam surface. This insures that the positions of the outer tips of the vanes are controlled positively in very closely spaced relationship to the inner surface of the stator.

When utilizing a round rotor and cam surface mounted eccentric with respect to each other, the vane tips will not track a perfectly round path. Therefore, if the stator inner surface is round, at certain portions of the vane travel the tips will move very slightly away from the stator inner surface. While this slight clearance will be acceptable in most instances, if higher tolerances are required, either the stator inner surface can be machined to match the path defined by the vane tips or the vane tips may be provided with lost cost, replaceable seals which are capable of limited movement into engagement with the stator inner surface with a very light pressure.

In one embodiment of the invention the inner ends of the vanes are extended longitudinally into the outboard area of the machine and the extended portions are in direct contact with a pair of cam surfaces which may be provided with bearings or, in a second embodiment, the cam followers can take the form of rollers in engagement with stationary cam surfaces.

Regardless of the particular embodiment of the present invention, it will be seen that a rotory machine is provided in which vane position is controlled positively to prevent vane lift while at the same time vane-stator frictional contact is minimized to avoid frictional energy losses and machine wear.

DESCRIPTION OF THE PREFERRED EMBODIMENTS

Figure 1:
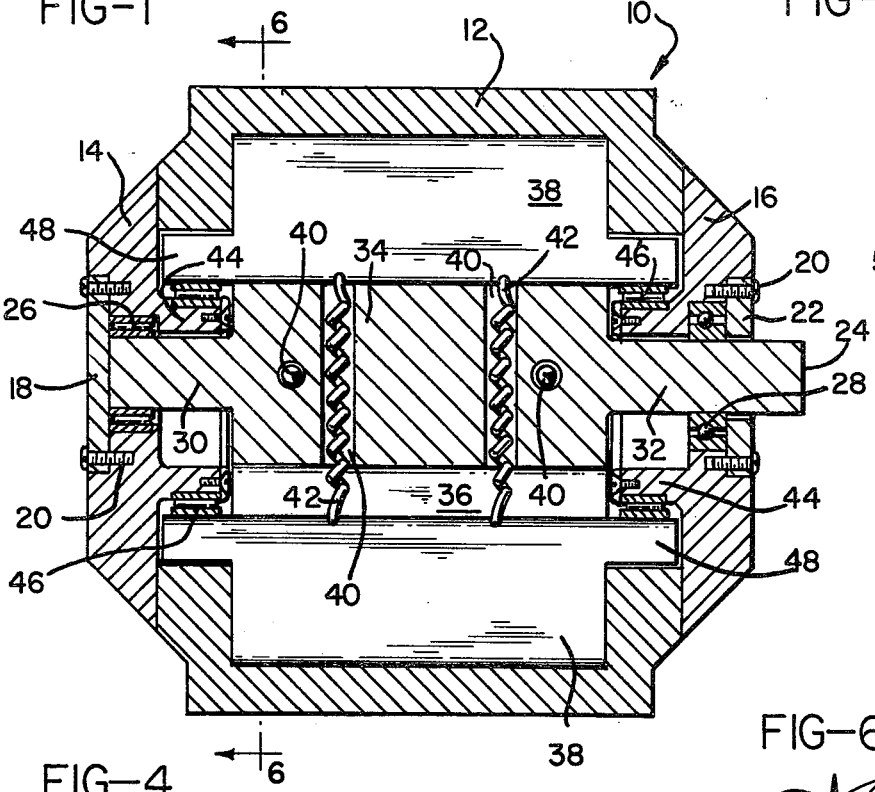
FIG. 1 is a cross-sectional view of a rotary machine in accordance with the present invention.
Figure 2:
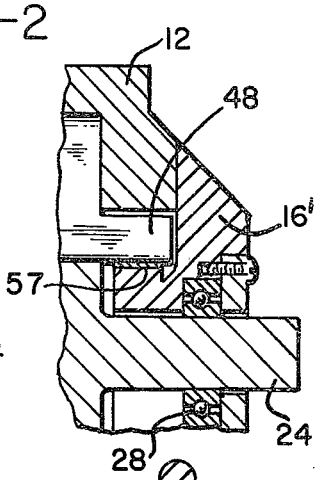
FIG. 2 is an enlarged fragmentary view showing a modification of the machine of FIG. 1.
Figure 8:
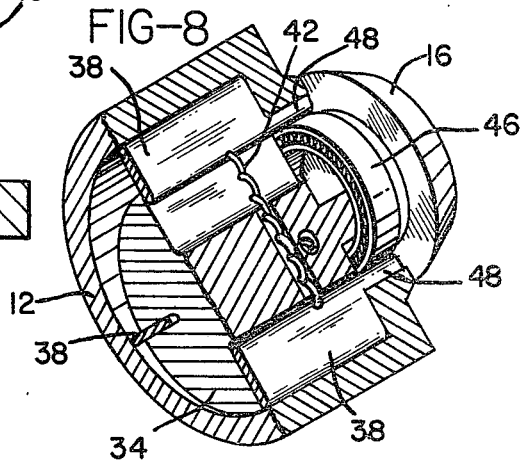
FIG. 8 is a fragmentary perspective view showing a portion of the structure of FIG. 1.

As seen in FIG. 1 of the drawings, a rotary machine 10 in accordance with the present invention includes a main stator housing 12 closed by end plates 14 and 16, a cap 18 secured by bolts or the like 20 to the end plate 14 and a cap 22 attached to the end plate 16 by bolts 20 and apertured to receive a shaft 24. End plates 14 and 16 are provided with bearings 26 and 28, respectively, for rotatably supporting the ends 30 and 32 of the rotor 34, which is also shown in FIGS. 2 and 8 of the drawings.

Rotor 34 is slotted, as indicated at 36, to slidably receive opposed pairs of vanes 38. Rotor 34 is also provided with through passages 40, as best seen in FIGS. 1 and 8 of the drawings, which accommodate tension springs 42 interconnecting the opposed pairs of vanes 38. In the outboard areas of the machine the end plates 14 and 16 are provided with inwardly projecting, annular cam surfaces 44, which may, as shown in FIGS. 1 and 8, be provided with bearings 46. The inner, heel ends of the vanes are extended longitudinally into the outboard area of the machine, the extended portions being indicated by the reference numeral 48, where they are held in firm engagement with the cam surfaces 44 by means of the tension springs 42.

Figure 9:
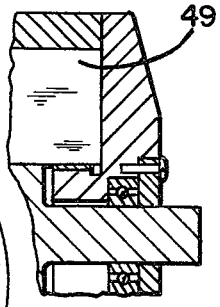
FIG. 9 is a fragmentary view showing a further modification of the invention.
Figure 7:
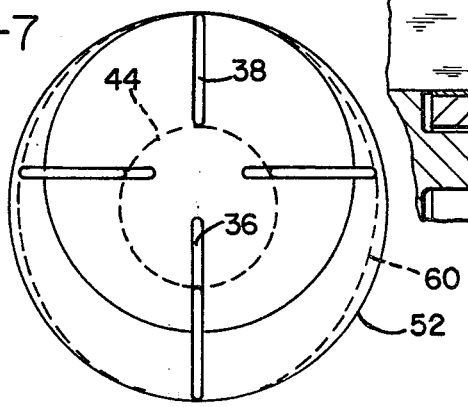
FIG. 7 is a view similar to FIG. 4 depicting a possible variation in the shape of the stator inner wall.

While the vanes are shown with projections 48 which give the vanes a T shape, it will be appreciated that the vanes may be simply rectangular in configuration as shown at 49 in FIG. 9 of the drawings.

With this arrangement it will be seen that as the rotor 34 rotates within the housing 12 the vanes 38, cooperating with the outer surface 50 of the rotor and the inner surface 52 of the stator, will form a series of discrete chambers. Where the rotary machine of the present invention is used, for example, as a compressor, the stator housing 12 may be provided with an inlet port 54 through which gas can be drawn into the housing for compression during rotation of the rotor and expelled through an outlet port 56.

The vanes are dimensioned with respect to the machine such that the vane tips just clear the inner surface 52 of the stator at their closest point, thus avoiding frictional energy losses and wear generated by rubbing contact between the vane tips and the inner surface 52 of the stator. Because the portions 48 of the vanes are held securely against the cam surfaces by the tension springs 42, positive control of the sliding movement of the vanes is provided, both insuring minimal contact between the vane tips and the housing inner wall and preventing vane lift in response to pressure buildups in the discrete chambers formed by the vanes and the outer and inner surfaces of the rotor and stator, respectively.

Figure 5:
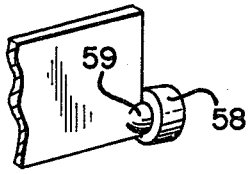
FIG. 5 is a fragmentary view of a modified vane.

While in the embodiments shown in FIGS. 1 and 8 of the drawings bearings are provided interposed between the cams and the vanes, in the embodiment shown in FIG. 2 of the drawings the cam surfaces are provided with a ring 57 of an appropriate material to facilitate sliding movement of the portions 48 of the vanes. Additionally, and as seen in FIG. 5 of the drawings, the inner ends of the vanes may be provided with rollers 58 journalled on axles 59 carried by the vanes.

Figure 6:
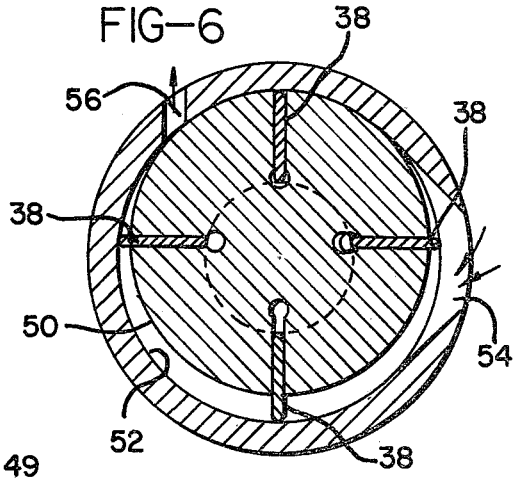
FIG. 6 is a view taken on line 6—6 of FIG. 1.

As seen in FIG. 6 of the drawings, the rotor 34, stator inner wall 52 and cam 44 are all preferably formed round for convenience of manufacture. However, the tips of the vanes as they move inwardly and outwardly by virtue of the eccentric mounting of the rotor 44 with respect to the axes of the stator inner wall 52 and cam 44, with track paths which deviate slightly from a true circle, as indicated by the dotted line 60.

Figure 3:
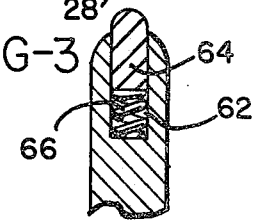
FIG. 3 is an enlarged fragmentary view showing a modified vane tip construction.

The clearance between the vane tips and the stator inner wall at, for example, approximately the 3 o'clock and 9 o'clock positions in the representation in FIG. 6 of the drawings, will be very slight. However, if desired any leakage around the vane tips occasioned by this deviation can be remedied by either machining the inner surface of the stator to the configuration indicated by the dotted line 60 or, as shown in FIG. 3 of the drawings, modifying the vane tips.

Thus, the tips of the vanes may be provided with a slot 62 which receives replaceable seals 64 formed of a material that is relatively soft in comparison to the material of which the stator inner wall is constructed and provided with relatively light springs 66 to maintain the seals 64 into light contact with the inner wall 52.

Figure 4:
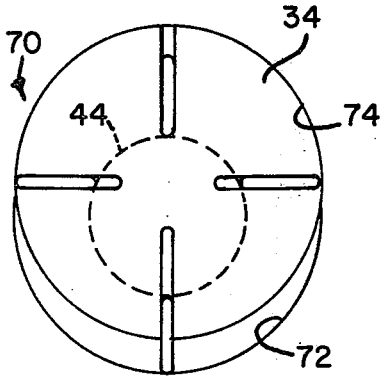
FIG. 4 is a somewhat diagrammatic representation of a modified stator housing.

Another approach to machining the inner surface of the stator housing is shown in FIG. 4 of the drawings wherein the modified stator inner surface 70 is comprised of two overlapping circles 72 and 74. The construction otherwise remains the same, with the round rotor 34, vanes 36 riding in slots 38 and a round cam 44.

While the forms of apparatus herein described constitute preferred embodiments of the invention, it is to be understood that the invention is not limited to these precise forms of apparatus, and that changes may be made therein without departing from the scope of the invention.

What is claimed is:

1. In a rotary machine including a stator housing having an inwardly facing, cylindrical, inner surface defining a chamber, inlet and outlet ports communicating with said chamber, a pair of continuous, substantially circular, outwardly facing cam surfaces fixed with respect to said stator housing and projecting inwardly thereof longitudinally of said chamber, a rotor mounted for rotation in said chamber and having a plurality of substantially radially oriented slots formed therein, and vanes received in said rotor slots, and including flat plate portions terminating in tip portions disposed adjacent said cylindrical inner surface of said stator housing and cam followers projecting outwardly of said vanes longitudinally of said chamber, the improvement comprising:

said cam followers on each of said vanes projecting over and directly adjacent to said outwardly facing cam surfaces, bearing means interposed between said cam followers and said cam surfaces, and tension means interconnecting said vanes and urging said cam followers thereof into engagement with said cam surfaces and said vane tip portions out of engagement with said stator housing inner surface.

2. The machine of claim 1 wherein:

said vanes are received in said rotor slots in opposed pairs, and said tension means extends through said rotor and interconnects said opposed pairs of vanes.

3. The machine of claim 1 wherein:

said tension means comprises spring means interconnecting said vanes.

4. The machine of claim 1 wherein:

said vanes are received in said rotor slots in opposed pairs, and said tension means comprises spring means extending through said rotor and interconnecting said opposed pairs of vanes.

5. In a rotary machine including a stator housing having an inwardly facing, cylindrical, inner surface defining a chamber, inlet and outlet ports communicating with said chamber, a rotor mounted for rotation in said chamber and having a plurality of substantially radially oriented slots formed therein, and opposed pairs of vanes received in said rotor slots, the improvement comprising:

a pair of continuous, substantially circular cam surfaces fixed with respect to said stator housing and projecting inwardly thereof longitudinally of said chamber with the axes of said cam surfaces disposed concentrically with respect to each other and to said stator inner surface and eccentrically with respect to the axis of rotation of said rotor, said vanes including flat plate portions terminating in tip portions disposed adjacent said cylindrical inner surface of said stator housing and pairs of cam followers projecting outwardly of said vanes longitudinally of said chamber adjacent said cam surfaces, bearing means interposed between said cam followers and said cam surfaces, and tension spring means extending through said rotor and interconnecting opposed pairs of said vanes and urging said cam followers thereof into engagement with said cam surfaces and said vane tip portions out of engagement with said stator housing inner surface.

* * * * *